US007806278B2

(12) United States Patent
Brida

(10) Patent No.: US 7,806,278 B2
(45) Date of Patent: Oct. 5, 2010

(54) BOTTLE STORAGE DEVICE

(75) Inventor: Hubert Brida, Letzestrasse 8, Frastanz (AT) A-6820

(73) Assignees: Lothar Collini, Klaus (AT); Hubert Brida, Frastanz (AT)

( * ) Notice: Subject to any disclaimer, the term of this patent is extended or adjusted under 35 U.S.C. 154(b) by 0 days.

(21) Appl. No.: 12/388,830

(22) Filed: Feb. 19, 2009

(65) Prior Publication Data

US 2009/0152219 A1 Jun. 18, 2009

Related U.S. Application Data

(63) Continuation of application No. PCT/AT2007/000373, filed on Aug. 1, 2007.

(30) Foreign Application Priority Data

Sep. 6, 2006 (AT) ..... A 1484/2006

(51) Int. Cl.
*A47B 73/00* (2006.01)

(52) U.S. Cl. ..... 211/74; 211/75; 211/106

(58) Field of Classification Search ..... 211/49.1, 211/74, 75, 106; D7/704; 206/503, 504
See application file for complete search history.

(56) References Cited

U.S. PATENT DOCUMENTS

| | | | | |
|---|---|---|---|---|
| 5,257,702 | A * | 11/1993 | Grafstein | 211/106 |
| 5,785,189 | A * | 7/1998 | Gollob et al. | 211/187 |
| 2003/0205543 | A1 | 11/2003 | Kao | |
| 2004/0104187 | A1 | 6/2004 | McCain | |

FOREIGN PATENT DOCUMENTS

| | | | |
|---|---|---|---|
| CH | 323288 | | 9/1957 |
| DE | 4328660 | | 3/1995 |
| DE | 20213295 | | 10/2002 |
| DE | 20309209 | | 8/2003 |
| DE | 20220354 | | 9/2003 |
| EP | 1029469 | | 8/2000 |
| EP | 1029469 | A1 * | 8/2000 |
| EP | 1442674 | | 8/2004 |
| FR | 453564 | | 6/1913 |
| GB | 190100146 | | 12/1901 |
| GB | 2221149 | | 1/1990 |
| JP | 2001201251 | A * | 7/2001 |
| JP | 2002136402 | A * | 5/2002 |

* cited by examiner

*Primary Examiner*—Korie Chan
(74) *Attorney, Agent, or Firm*—Volpe and Koenig, P.C.

(57) ABSTRACT

A bottle storage device, particularly a bottle rack, is provided for at least one double row (7) including a first row (2) and a second row (3) of bottles (1) and resting on a support assembly (11), with each support assembly (11) having a first support assembly part (6) and a second support assembly part (10) for supporting the lateral surfaces (5) of the bottles (1), and a third support assembly part (8) is arranged between them for supporting the bottle necks (4) of the bottles (1), with the support assembly parts (6, 8, 10) each being spaced apart from each other. The third support assembly part (8) projects freely from a rear side of the bottle storage device, opposite the removal side, extending towards the removal side. Stops (14) are provided for the lateral surfaces (5) of the rearmost bottle (1) of the first and the second row (2, 3), which are off-set in reference to each other in a direction of the rows (2, 3).

10 Claims, 6 Drawing Sheets

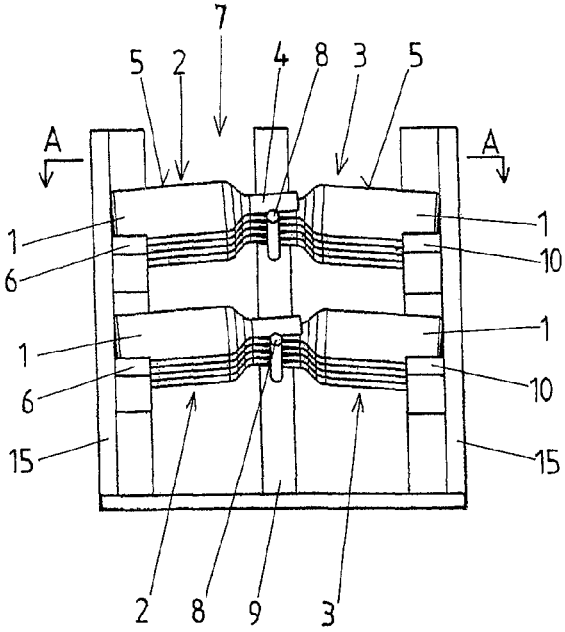
Fig. 1
Fig. 2
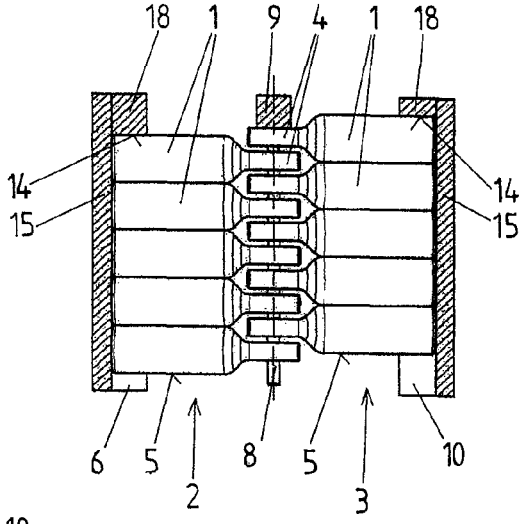
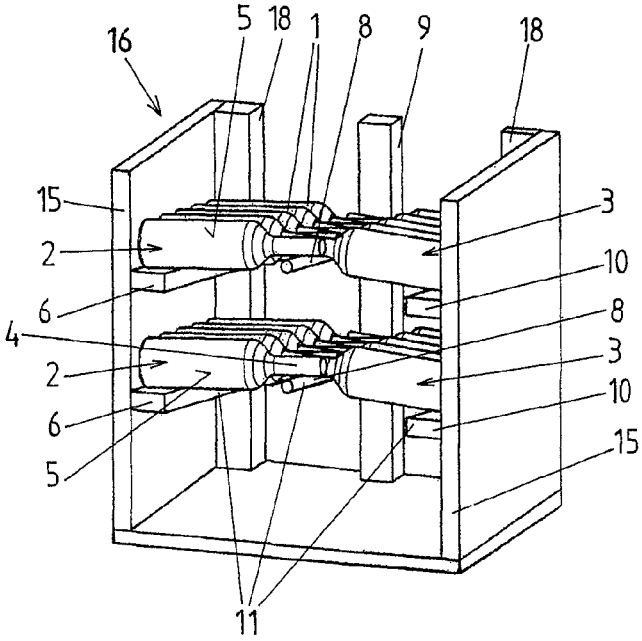
Fig. 3

Fig. 4
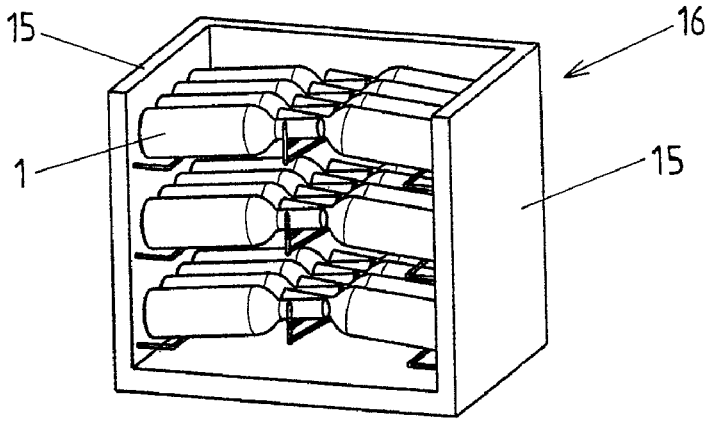
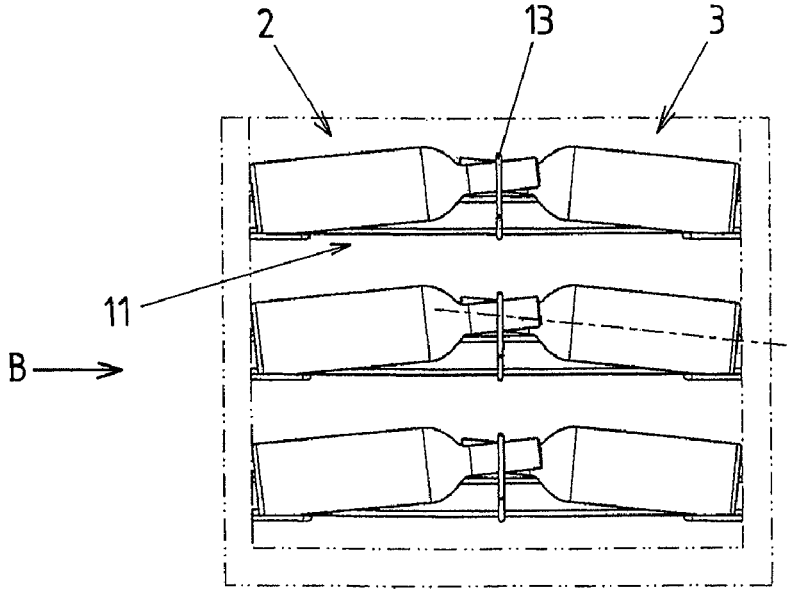
Fig. 5

BOTTLE STORAGE DEVICE

CROSS-REFERENCE TO RELATED APPLICATIONS

This application is a continuation of International Application No. PCT/AT2007/000373, filed Aug. 1, 2007, which claims the benefit of Austrian Application No. A1484/2006, filed Sep. 6, 2006, both of which are incorporated herein by reference as if fully set forth.

BACKGROUND

The invention relates to a bottle storage device, particularly a bottle rack, for at one double row of bottles formed by a first row and a second row and supported on a support assembly, with each support assembly comprising a first support assembly part for supporting the lateral surfaces of the bottles of the first row and a second support assembly part for supporting the lateral surfaces of the bottles of the second row and a third support assembly part arranged therebetween to support the bottle necks of the bottles of both rows of the double row, with the respective support assembly parts being distanced from each other.

Bottle storage devices, particularly in the form of bottle racks, for example implemented as wine (storage) racks or sales and display racks are known in various embodiments. A rack unit of the type mentioned at the outset is known from DE 43 28 660 A1, in particular for storing wine bottles of all sorts and displaying them, in particular, for sale. In this bottle rack, in which the central rack bars are continuously supported vertically at both sides, loading and/or unloading the stored material occurs parallel in reference to the longitudinal axis of the stored material from both sides of the bottle rack. This is particularly disadvantageous when using the rack unit for sales display, because signets and product information are usually applied at the lateral surfaces of the goods to be displayed and customers want to access the selected goods without any delay in case of a positive decision for purchase. A similar bottle rack is also known from EP 1 029 469 A1.

From GB 2 221 149A a bottle storage device is known in which the individual bottles can be stored laying over top of each other. For this purpose, at both sides holding parts are provided for the respective bottoms of the bottles and in the middle holding parts for the bottle necks, formed by freely projecting pins. This bottle storage device has a comparatively low storage capacity and each bottle must be inserted precisely into the holding parts which are formed relatively small.

US 2004104187A1 also shows a bottle storage device with freely projecting bars to support the lateral surface and the bottle neck of a respective bottle. When rows comprising several bottles are formed with this bottle storage device a very high stress of the projecting bars develops. Additionally, the storage capacity in reference to the volume of the device is limited as well.

SUMMARY

The object of the invention is to provide a bottle storage device, which can easily be loaded and from which the stored material again can easily be unloaded while providing a high storage capacity in reference to the volume of the device and which can be produced in a cost-effective manner.

According to the invention this is attained in a bottle storage device for at least one double row of bottles formed by a first row and a second row of bottles comprising at least one support assembly to support the double row, which comprises a first support assembly part to support the lateral surfaces of the bottles of the first row and a second support assembly part to support the lateral surfaces of the bottles of the second row and a third support assembly part arranged therebetween to support the bottle necks of the bottles of both rows of the double row, and a first stop for the lateral surface of the rearmost bottle of the first row and a stop for the lateral surface of the rearmost bottle of the second row, with the support assembly parts being spaced apart from each other and the third support assembly part being embodied freely projecting towards the removal side from a rear side of the bottle storage device, located opposite a removal side, and with the first and second stops for the lateral surface of the rearmost bottle of the first and the second row being positioned off-set in reference to each other in the direction of the rows.

According to the invention, in this way the central support assembly part is embodied projecting freely towards the removal side from a rear side of the bottle storage device opposite the removal side, i.e. it is not supported at the removal side of its rear fastening. This allows loading and unloading of the bottles, for example wine bottles, without any obstructions. Further, stops are provided for the lateral surfaces of the rearmost bottle of the first and the second row. The stop for the first row is off-set in reference to the stop for the second row in the direction of the rows.

In an advantageous embodiment of the invention, the third support assembly part is provided with a front stopper projecting upwards in the area of its freely projecting end. In this way, the unintentional falling of bottles out of the bottle storage device at the removal side is prevented, while the stopper can be embodied so short that the removal of bottles is not hindered in the central area of the removal side.

Advantageously the bottles of the two rows of a double row are arranged on their support assemblies such that the bottles of the two rows are arranged off-set in reference to each other in the direction of the rows, with the bottle necks overlapping in the area of the central support assembly part, resulting in a space-saving storage.

BRIEF DESCRIPTION OF THE DRAWINGS

In the following additional advantages and details of the invention are explained using the attached drawings.

In the drawings:

FIG. 1 is a schematic front view of a first embodiment of a bottle storage device according to the invention with two support assemblies arranged one over top of the other and fully stocked with a double row of bottles;

FIG. 2 is a cross-section along a line 2-2 in FIG. 1;

FIG. 3 is a schematic perspective view from the front and above onto the first embodiment of the bottle storage device according to the invention;

FIG. 4 is a schematic perspective view from the top front to a bottle storage device according to the invention according to a second embodiment;

FIG. 5 is a front view of the bottle storage device of FIG. 4, the support assemblies and the bottles only in a continuous line, the remainder is shown in dot-dash lines;

DETAILED DESCRIPTION OF THE PREFERRED EMBODIMENTS

Figure 6:
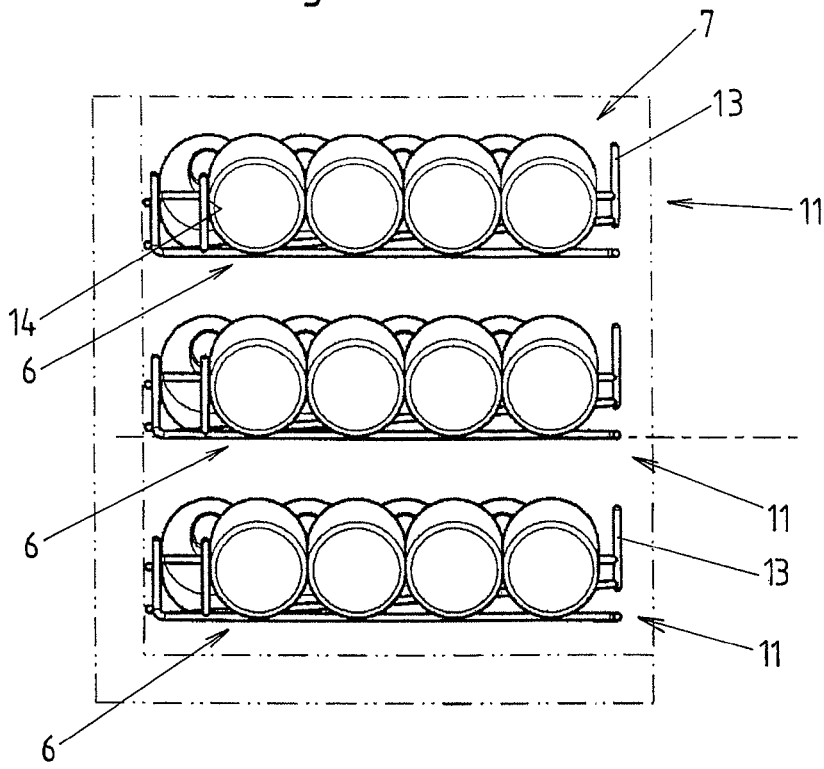
FIG. 6 is a side view of the bottle storage device of FIG. 4, the support assemblies and the bottles only in a continuous line, the remainder in dot-dash lines; taken in the direction arrow B in FIG. 5.
Figure 7:
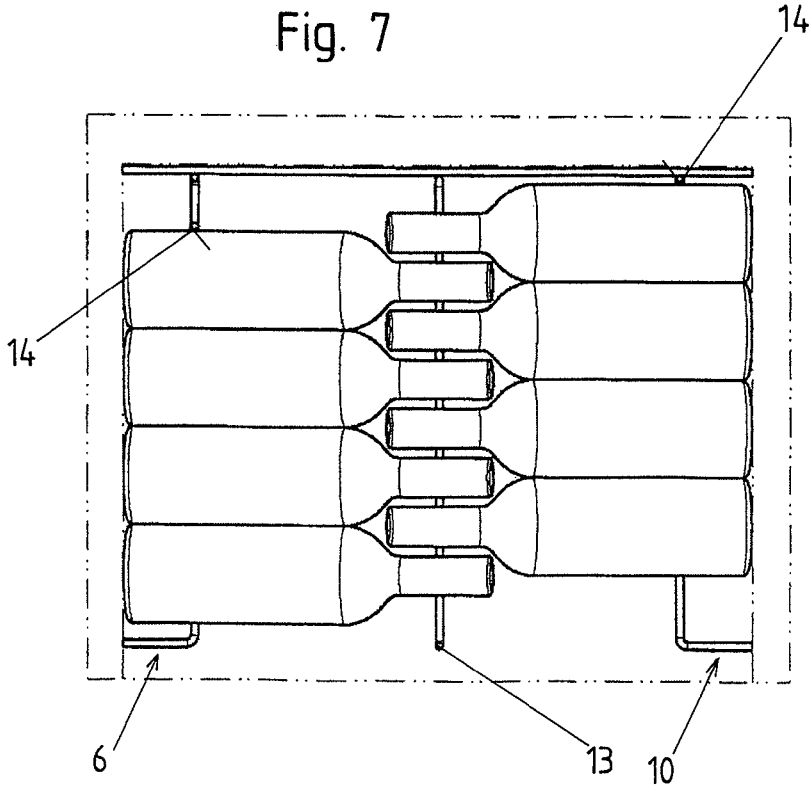
FIG. 7 is a view from the top onto the bottle storage device of FIG. 4, the support assemblies and the bottles only in a continuous line, the remainder in dot-dash lines.
Figure 8:
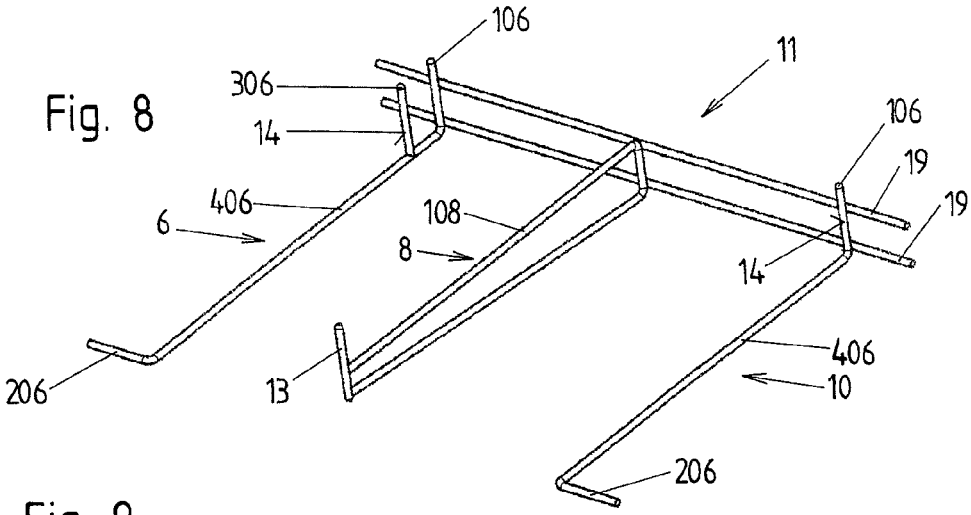
FIG. 8 is a schematic perspective view of the support assembly without any bottles from the front and above according to the second embodiment of the invention.
Figure 9:
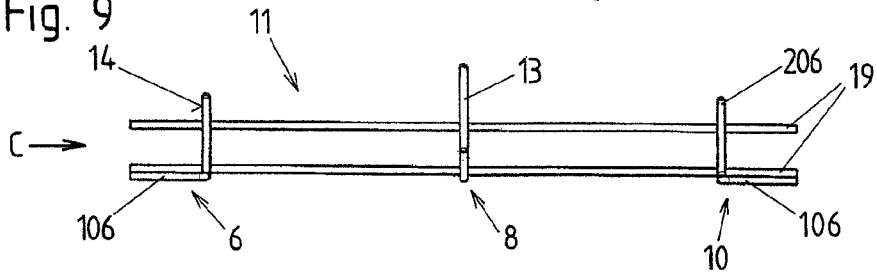
FIG. 9 is a front view of the support assembly of FIG. 8.
Figure 10:
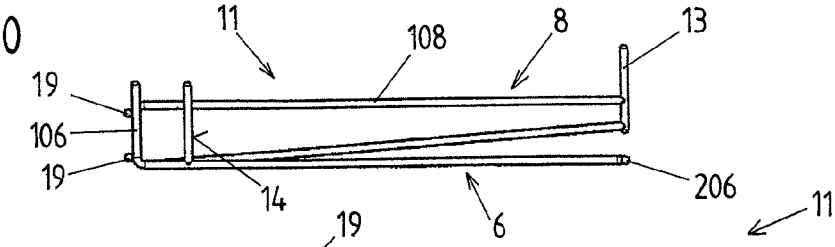
FIG. 10 is a side view of the support assembly; taken in the direction of arrow C in FIG. 9.
Figure 11:
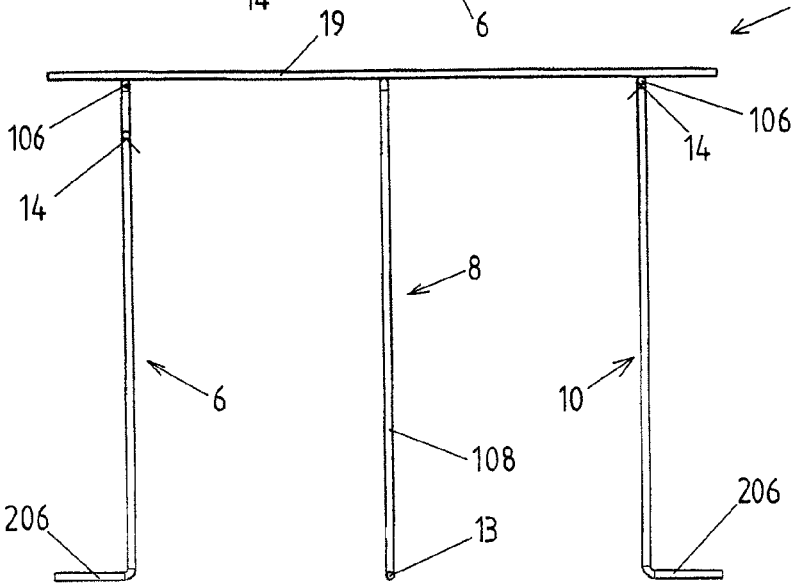
FIG. 11 is a view from the above onto the support assembly of FIG. 8.

When this document refers to the "left" and/or "right" these identifications of the sides each relate to a front view of the bottle storage device and/or the support assembly seen from the removal side. The statement "front" and/or "rear" are to be understood that "front" represents the removal side and "rear" the side of the rear wall of the body.

"Top" and/or "bottom" refer to the bottle storage device in its operational position.

FIGS. 1 through 3 show a first embodiment of the bottle storage device according to the invention for two double rows 7 of bottles 1, arranged one over top of the other, each of them resting on a support assembly 11 and formed by a first row 2 and a second row 3 of bottles 1.

The bottles 1 each comprise a bottom of the bottle, a cylindrical lateral surface 5, and a bottle neck 4 with its diameter being reduced in reference to the lateral surface 5.

The bottle storage device has a body 16 with two body side walls 15 and rear body parts. Here, the rear wall of the body is not embodied continuously but is formed by two rear wall-side parts 18 of the body, each extending towards the center and a rear wall-center part 9 of the body extending vertically between them. Each of the two rear wall-side parts 18 of the body is connected fixed to the corresponding side wall 15 of the body. The left rear wall-side part 18 of the body has a slightly greater thickness than the right rear wall-side part 18 of the body, for reasons explained in below. The body 16 is embodied open at the removal side (i.e., the front), located opposite the rear wall of the body. It can also be embodied lockable, e.g., via a cabinet door. It is also embodied open at the top. However, it could also be closed with a cover part, an upper cabinet top etc.

The two support assemblies 11 arranged one over top of the other are arranged inside the body 16. When the bottle storage device is seen from the front, here two first support assembly parts 6 are arranged at the left side wall of the body one over top of the other and at the right side wall of the body two second support assembly parts 10 arranged one over top of the other. The lateral first and second support assembly parts 6, 10 are here each embodied as bars (beams) connected to the side walls 15 of the body. For example, individual support elements are also possible and can be imagined, e.g., rows of pins projecting from blind holes in the side walls 15 of the body. The first and second support assembly parts 6, 10 serve to support the lateral surfaces 5 of the bottles 1. Here, the area of the lateral surface 5 adjacent to the bottom of a bottle 1 rests on these lateral support assembly parts 6, 10.

Each of the two support assemblies 11 additionally has a third support assembly part 8 arranged between the lateral support assembly parts 6, 10 to support the bottle necks 4 of the bottles 1. In this embodiment this central support assembly part 8 is formed by a straight round rod each, which freely projects from the rear side of the bottle storage device (opposite the removal side) and extend towards the removal side. The two round rods are here each inserted into a blind hole of the rear wall-central part 9 of the body. However, they could also be connected to the rear wall-central part 9 of the body via screws extending through bores in the rear wall-central part 9 of the body into the interior of the body 16. In such a case axial threaded bores or blind bores with inserted nuts for fixing the round rods were to be provided in the rear wall ends of the round rods. Other known fastening methods are also possible and can be utilized as well.

The lateral surfaces of the two rear wall-side parts 18 of the body facing the interior of the body 16 form stops 14 for the lateral surface 5 of the rearmost bottle of the first and second row 2, 3, offset in reference to each other in the direction of the rows 2, 3. However, the off-set position results, as already mentioned, from the left rear wall-side part 19 of the body having a slightly greater thickness than the right rear wall-side part 18 of the body.

The bottle necks 4 of the bottles 1 of the first row 2 and the second row 3 of a double row 7 are supported alternating on the round rods forming the respectively third support assembly part 8, with the bottle necks 4 of two neighboring bottles 1 each overlapping, with one being part of the first row 2 and the other of the second row 3. In other words, the bottles 1 of a double row 7 are arranged alternating off-set in the lateral direction (left/right) from the rear towards the front on a support assembly 11, with their bottle necks 4 resting alternating overlapped on the central support assembly part 8 (FIG. 2.)

As clearly discernible from FIG. 1 the first support assembly part 6 and the second support assembly part 10 and the third support assembly part 8 of a support assembly 11 are arranged advantageously such that the longitudinal axes of the stored bottles 1 are each inclined in reference to the horizontal level. Storing wine bottles slightly inclined in reference to the horizontal achieves that the deposits precipitate at the bottom of the bottles, which is advantageous when pouring the wine.

Preferably the support surfaces of the support assembly parts 6, 8, 10 extend declining from the removal side towards the rear side, as particularly discernible from FIG. 1. When applying one or more stoppers for the bottles in the area of the end of the central support assembly part 8 and/or the lateral support assembly parts 6, 10 at the removal side, the support assembly parts 6, 8, 10 may also extend horizontally or extend declining downwards towards the removal side.

Due to the fact that for each double row a removal opening is provided continuous over the width of the double row, the bottles 1 can easily and comfortably be stocked and/or removed. Here, when loading a double row the bottles are inserted alternating into both rows 3, 2. The first bottle is here placed into the row 3, in which the rear stop 14 is located further back, thus the row 3 shown at the right in FIGS. 1 through 3.

The bottle storage device according to the invention may also be embodied for only one or for more than two double rows 7, with a respective number of support assemblies 1 being provided.

A bottle storage device similar to the first embodiment, however with a modified embodiment of the support assembly 11, is shown in FIGS. 4 through 11. Here, the bottle storage device has three double rows 7 for bottles 1. Accordingly, three support assemblies 11 are provided as well. However, there could also be more or less than three.

Contrary to the previously shown exemplary embodiment, the body 16 has a continuous rear wall 17 here.

Each support assembly 11 is here welded together from rod-shaped round steel parts (preferably via spot welding). The rods may also be made from another material, for example a metal, such as aluminum or a stiff plastic. They may also be adhered together at the connection sites or be connected to each other by another known manner, other than welding. The first and second support assembly part 6, 10 and the freely projecting third support assembly part 8 are here vertically spaced from each other and welded parallel in reference to the rear wall 17 of the body and the horizontally extending round steel rods 19, which at the rear side project into the blind holes inserted in the side walls 15 of the body. Here, the first and/or the second support assembly parts 6, 10 essentially comprise a round steel rod each, with its two end sections 106, 206 essentially being bent over at a right angle in reference to the longitudinal axis of the rod. The two bent end sections 106, 206 are further bent into directions essentially perpendicular in reference to each other. While the end section 106 arranged at the rear projects upwards, the front end section 206 projects towards the corresponding side wall 15 of the body. Each of the two rear end sections 106 are welded to the two round rods 19 at their two intersecting areas. Each of the front end sections 206 projects into a blind hole inserted at the removal side, i.e. at the front of the side walls 15 of the body. The lateral surface support sections 406 of the first support assembly part 6 and the second support assembly part 10 here extend horizontally from the rear to the front. They could also extend inclined downwards or upwards from the rear to the front.

Preferably one of the support assembly parts, for example the first support assembly part 6, has a stop 14 for the lateral surface 5 of the rearmost bottle of the row allocated thereto. It is formed e.g., by a round steel rod 306, projecting upwards and thus extending parallel in reference to the rear end section 106 of the first support assembly part 6 and welded thereto with its lower end. It could also be connected thereto in a different fashion. The stop 14 of the second support assembly part 10 for the second row 3 is formed by the rear end section 106 of the second support assembly part 10. As clearly discernible from FIGS. 8, 10, and 11, both stops 14 of the first support assembly part 6 and the second support assembly part 10 are off-set in reference to each other in the direction of the rows 2, 3.

Due to the fact that the bottle neck support section 108 of the third support assembly part 8 serving to support the bottle necks 4 of the bottles 1 both of the first row 2 as well as the second row 3 of a double row 7 of bottles 1, and here the lateral surface support sections 406 of the first support assembly part 6 and the second support assembly part 10 extend horizontally, the third support assembly part 8 is provided with a front stopper 13 projecting upwards in the area of its freely projecting end in order to prevent any the bottles 1 from unintentionally falling out. Such a stopper 13 is also and particularly advantageous in an embodiment of the bottle storage device in which the support assemblies 11 each extend declined downwards from the rear to the front.

The above-described embodiment of the support assembly 11, shown in FIGS. 4 through 11, can also be used as an attachment, suspended at a rear wall and removable therefrom, for example a sales or display shelf. The suspension and/or fastening at the rear wall can then occur via clamping parts, for example, which on the one hand are held to the rear wall by screws, for example, and which on the other hand determine at least one of the two vertically distanced round rods 19, extending parallel in reference to the rear wall and horizontally, preferably at least at two points along its longitudinal extension along the rear wall.

A third embodiment of a support assembly 11 is shown in FIGS. 12 through 15. This embodiment can also be used as a part inserted into a body 16 or as an attachment suspended at a rear wall and removable therefrom, for example in form of a sales or display shelf. However, the embodiment of the fasteners in the body or at the rear wall may be different than in the second embodiment of the support assembly 11, due to the different embodiment at the rear as well as the different embodiment of the third support assembly part 8. The support assembly 11 is here also preferably welded together from rod-shaped round steel parts (preferably via spot welding) and the progression of these rods declines from the rear towards the front in reference to a horizontal level, positioned perpendicular in reference to the rear wall.

Figure 12:
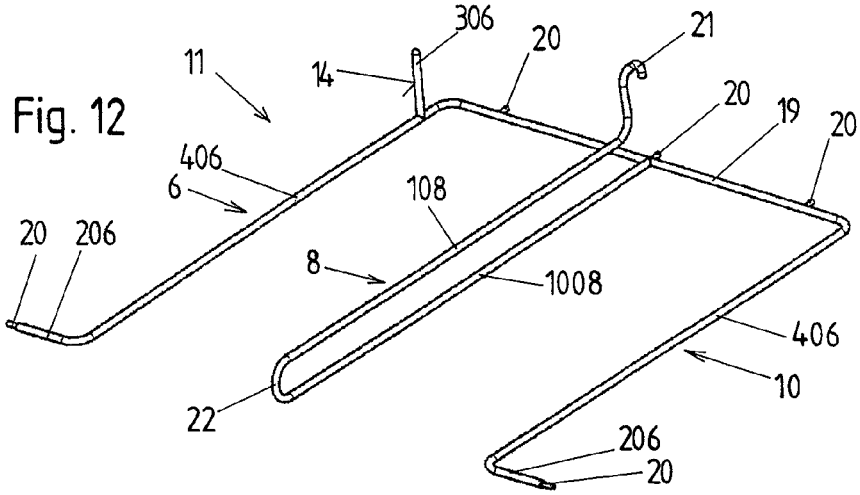
FIG. 12 is a schematic perspective view from the front and above onto a third embodiment of the support assembly without any bottles.
Figure 13:
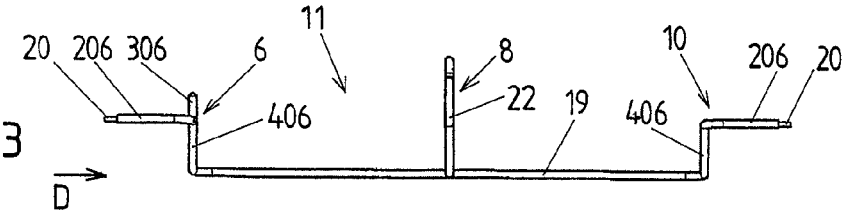
FIG. 13 is a front view of the support assembly of FIG. 12.
Figure 14:
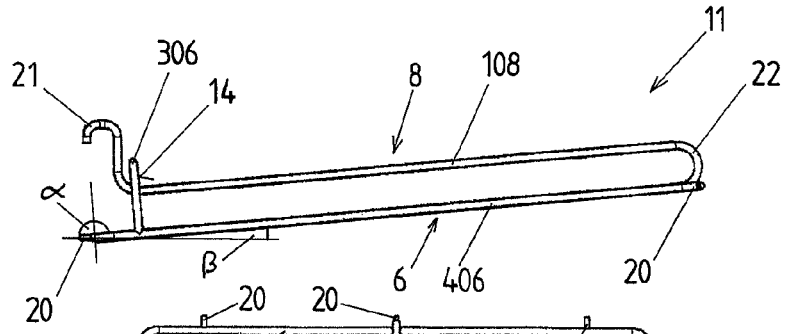
FIG. 14 is a side view of the support assembly of FIG. 12; taken in the direction of arrow D in FIG. 13.
Figure 15:
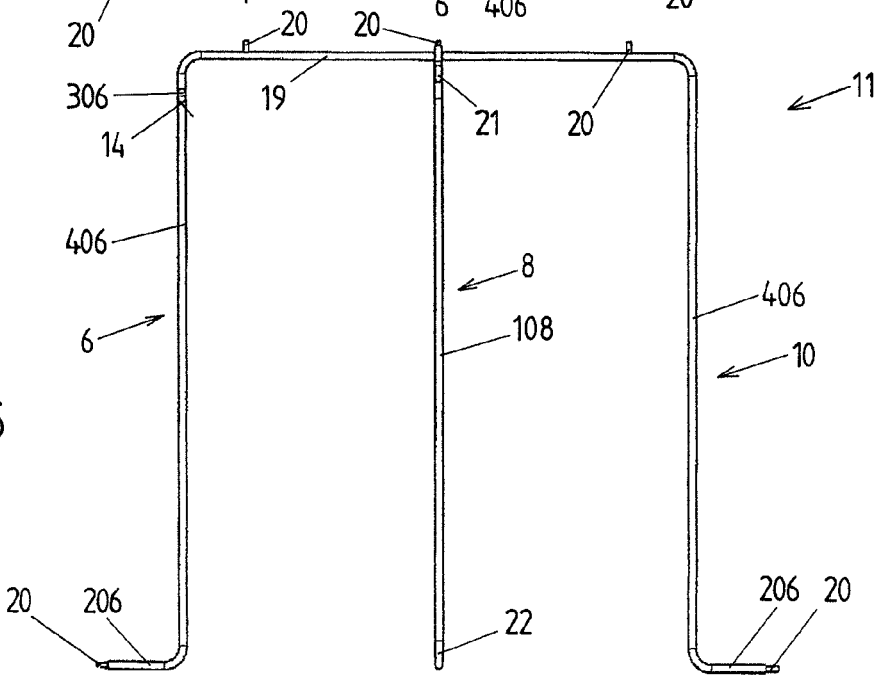
FIG. 15 is a view from above onto the support assembly of FIG. 12.
Figure 16:
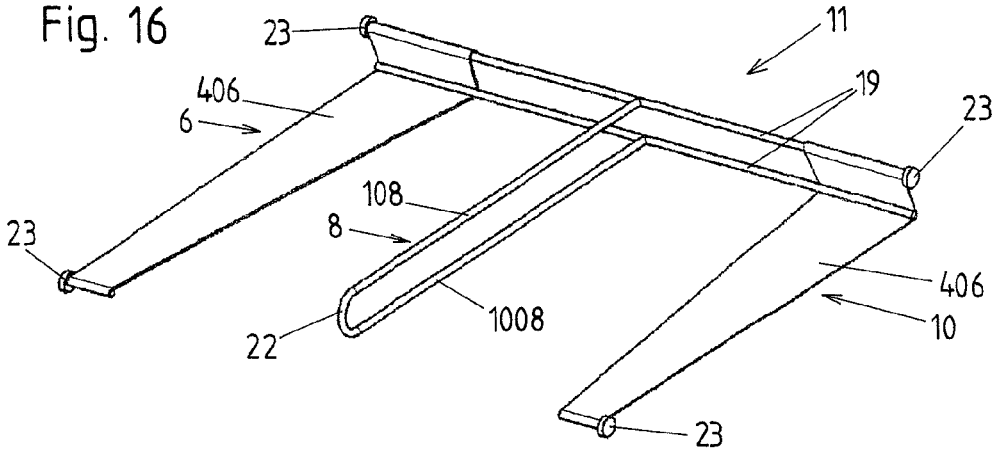
FIG. 16 is a schematic perspective view from the front and above onto a fourth embodiment of a support assembly without any bottles.
Figure 17:
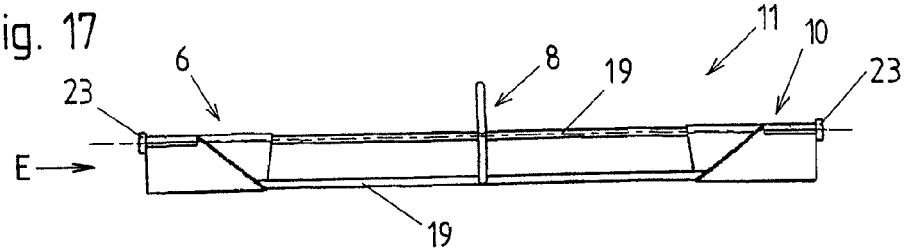
FIG. 17 is a front view of the support assembly of FIG. 16.
Figure 18:
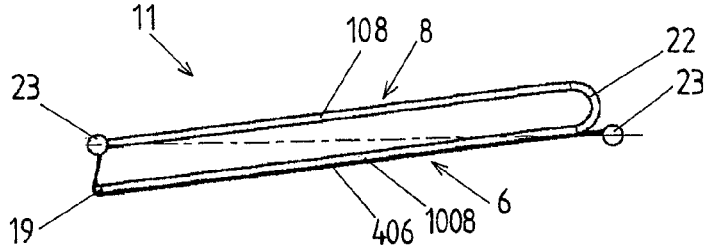
FIG. 18 is a side view of the support assembly of FIG. 16; taken in the direction of arrow E in FIG. 17.
Figure 19:
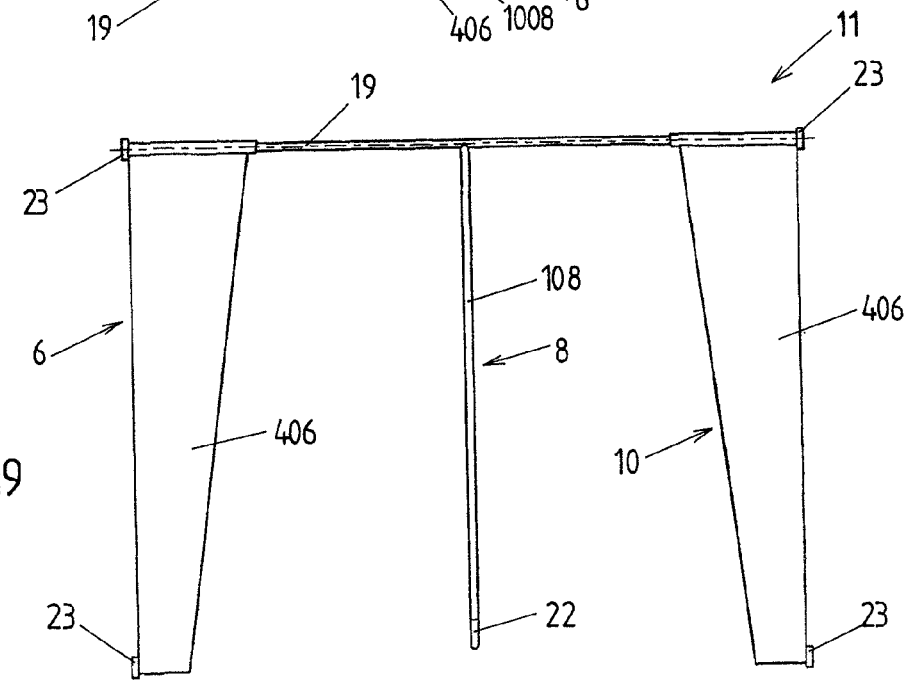
FIG. 19 is a view from above onto the support assembly of FIG. 16.

The first and second support assembly part 6, 10 is here formed by two sections of a round steel rod 19 each (FIG. 12). Here, the first and the second support assembly parts 6, 10 each comprise, in reference to the longitudinal axis of the section of the round steel rod 19 arranged between the two support assembly parts 6, 10, sections of the round steel rod 19 bent at a right angle. The section of this round steel rod 19 arranged between the two support assembly parts 6, 10, when the support assembly 11 is inserted into a bottle rack and/or when inserted into a sales or display shelf parallel in reference to the rear wall and extending horizontally, is fixed thereto. The two, in reference to the removal side, frontal end sections 206 of the first and second support assembly part 6, 10 each end in a pin 20. The pins 20 each have a slightly smaller diameter than the remainder of the round steel rod 19. When side walls or lateral supports are provided, they can project into bores in the side walls or lateral supports. By the smaller diameter the circular edges developing here can cover the edges of the bore holes. This is particularly advantageous in sales and display shelves for the look of the product appearing of higher value thereby.

Along the rear section of the round steel rod 19, arranged between the first support assembly part 6 and the second support assembly part 10, pins 20 are provided as well. These pins are in line with the longitudinal axis of these sections. They describe an obtuse angle $\alpha$ of approx. 175° with the longitudinal axes of the lateral surface support sections 406 of the first support assembly part 6 and the second support assembly part 10.

Here, too, the first support assembly part 6 has a stop 14 for the lateral surface 5 of the rearmost bottle of the first row 2, formed by a round steel rod 306. It projects upwards in line with the longitudinal axis of the lateral surface support section 406 of the first support assembly part 6. However, it could also project in a different direction upwards, for example vertically upwards.

As mentioned above, here in the inserted and/or mounted state of the support assembly 11 of the bottle neck support section 108 of the third support assembly part 8 and also the lateral surface support sections 406 of the first support assembly part 6 and the second support assembly part 10 extend inclined upwards from the rear towards the front in reference to the horizontal level. This position develops during the assembly and/or the insertion and is maintained due to a difference in length of the bottle neck support section 108 and a section 1008 of the third support assembly part 8, formed in once piece therewith via a 180° return bend 22 at the removal side towards the rear section of the round steel rod 19, arranged between the first support assembly part 6 and the second support assembly part 10, and welded thereto. The bottle neck support section 108 ends in a hook 21 formed by bending the round steel rod twice, forming the third support assembly part 8. The first bending is arranged following the bottle neck support section 108. Here, in its progression the round steel rod experiences a change of direction by approximately 90° upwards. To a short straight section a second bend follows, by which the hook 21 is ultimately formed. As particularly discernible from FIG. 14 when the hook 21 is suspended at the rear wall and the rear pin 20 is inserted into the bores at the rear wall said incline develops. The inclination angle β in reference to the horizontal would here amount to approx. 5°.

As clearly shown in the above description, this third embodiment of the support assembly 11 is suitable both to form an insertion part easily insertable into the body 16 of a bottle storage device and easily removable therefrom, as well as suitable to form an attachment suspended at a rear wall and removable therefrom.

A fourth embodiment of a support assembly 11 is shown in FIGS. 16 through 19. Here, the first support assembly part 6 and the second support assembly part 10 are each formed from sheet metal. They could also comprise one or more appropriately shaped plastic parts. The lateral surface support sections 406 are essentially in the form of trapezoids (FIG. 19) in a top view. The first and second support assembly part 6, 10 and the third support assembly part 8 are connected to two rear round steel rods 19, extending parallel in reference to each other and vertically spaced apart from each other. At their ends at the removal side, the first support assembly part 6 and the second support assembly part 10 are each formed with a bend, having a relatively small curvature. The curvature of the sheet metal must be so small that a pin, serving as the rotation axis for a rotating body 23, can be held by such an end at the removal side.

At its rear end the sheet metal is bent around the lower one of the two round steel rods 19 and is connected thereto. The lower round steel rod 19 could e.g., be welded or adhered to the sheet metal along this bend. Following the bend, the sheet metal extends to the upper round steel rod 19, and is connected thereto. Here, it is bent around it such that an essentially cylindrical hollow space develops, in which the upper round steel rod 19 is held. Additional rotating bodies 23 are provided at the two ends of the upper round steel rod 19.

The third support assembly part 8 here comprises a round steel rod bent in a U-shaped manner, with the ends of the legs of the U each being connected to one of the rear round steel rods 19, for example welded thereto. The bend 22 of the U-shaped round steel rod is arranged at the removal side.

This fourth embodiment of the support assembly 11 can be used as an insertion and/or pushed-in part in a body of a bottle storage device, equipped with bars or rails extending from the rear to the front, e.g., horizontally. One front and one rear rotating 23 each can then be placed upon such a bar or rail and can be displaced along it. For example, this fourth embodiment of the support assembly 11 can also be used as an insertion and/or pushed-in part in a refrigerator. In such a case the body of the bottle storage device would be formed by the body of the refrigerator.

Different modifications of the described embodiments of the bottle storage device can be imagined and are possible without leaving the range of the invention. The third support assembly part 8 could also be formed by two horizontally distanced rods, for example, freely projecting towards the removal side.

It can also be imagined and is possible that the front stopper 13 or the rear stop 14, if formed by an essentially rod-shaped element, is embodied telescopic and/or insertable and/or pivotal.

The cross-sections of the steel rods used could also be embodied oval or rectangular.

LEGEND OF THE REFERENCE CHARACTERS

| | |
|---|---|
| 1 | bottles |
| 2 | first row |
| 3 | second row |
| 4 | bottle neck |
| 5 | lateral surface |
| 6 | first support assembly part |
| 7 | double row |
| 8 | third support assembly part |
| 9 | rear wall-central part of the body |
| 10 | second support assembly part |
| 11 | support assembly |
| 13 | front stopper |
| 14 | stop |
| 15 | side wall of the body |
| 16 | body |
| 17 | rear wall of the body |
| 18 | rear wall-side part of the body |
| 19 | round steel rod |
| 20 | pin |
| 21 | hook |
| 22 | bend |
| 23 | rotating body |
| 106 | end section |
| 108 | bottle neck support section |
| 206 | end section |
| 306 | round steel rod |
| 406 | lateral surface support section |
| 1008 | section |

The invention claimed is:

1. A bottle storage device for at least one double row (7) of bottles (1), formed by a first row (2) and a second row (3) of bottles (1), the device comprising at least one support assembly (11) for supporting the double row (7), which comprises a first support assembly part (6) for supporting lateral surfaces (5) of the bottles (1) of the first row (2) and a second support assembly part (10) for supporting lateral surfaces (5) of bottles (1) of the second row (3) and a third support assembly part (8) arranged between the first and second parts to support bottle necks (4) of the bottles (1) in both rows (3, 4) of the double row (7), a first stop (14) for the lateral surface (5) of a rearmost one of the bottles (1) of the first row (2) and a second stop (14) for the lateral surface (5) of a rearmost one of the bottles (1) of the second row (3), the first, second and third support assembly parts (6, 8, 10) being spaced apart from each other, and the third support assembly part (8) projects freely from a rear side of the bottle storage device, positioned opposite a removal side, and extends with a free end directed toward the removal side, and the first and second stops for the lateral surfaces (5) of the rearmost bottle (1) of the first and the second row (2, 3) are off-set in reference to each other in a direction of the rows (2, 3), and the first, second and third support assembly parts (6, 10, 8) are arranged such that longitudinal axes of the stored bottles are each inclined in reference to a horizontal plane with the longitudinal axes of each of the stored bottles rising toward the bottle neck supported on the third support assembly part (8).

2. A bottle storage device according to claim 1, wherein the third support assembly part (8) is formed by at least one rod freely projecting towards the removal side.

3. A bottle storage device according to claim 1, wherein at least one of a respective one of the first support assembly parts (6) or a respective one of the second support assembly parts (10) extends continuously over a length of the respective row (2, 3).

4. A bottle storage device according claim 1, wherein the bottles (1) can each be supported on the first support assembly part (6) and the second support assembly part (10) with sections of the lateral surfaces (5) adjacent to a bottom of the bottle.

5. A bottle storage device according to claim 1, wherein the third support assembly part (8) is provided with a front stopper (13) that protrudes upwards in an area of its freely projecting end.

6. A bottle storage device according to claim 1, wherein two or more of the support assemblies (11) are arranged one over top of the other, to provide for two or more double rows (7).

7. A bottle storage device according to claim 1, wherein the support assembly (11) is formed by an insertion part that can be inserted into a body (16) of the bottle storage device and removed therefrom.

8. A bottle storage device according to claim 1, wherein the support assembly (11) includes an attachment that can be suspended from a rear wall and can be removed therefrom.

9. A bottle storage device according to claim 1, wherein two or more of the support assemblies (11) are arranged one over top of the other for holding one double row (7) each, and for each of the double rows (7), the first and second stops (14) are provided for the lateral surfaces (5) of the rearmost bottles (1) of the first and second row (2, 3), off-set in reference to each other in the direction of the rows (2, 3).

10. A bottle storage device according to claim 1, wherein the bottle storage device comprises a bottle rack.

* * * * *